United States Patent [19]

Tanaka et al.

[11] Patent Number: 5,052,467

[45] Date of Patent: Oct. 1, 1991

[54] CONTROL DEVICE AND A CONTROL METHOD FOR TWIN-ROLL CONTINUOUS CASTER

[75] Inventors: Shigenori Tanaka; Takashi Furuya, both of Hikari; Hiroyuki Kajioka, Kimitsu; Shigeru Ogawa, Kitakyushu; Kunimasa Sasaki; Atsumu Yamane, both of Hiroshima, all of Japan

[73] Assignees: Nippon Steel Corporation; Mitsubishi Jukogyo Kabushiki Kaisha, both of Tokyo, Japan

[21] Appl. No.: 560,361

[22] Filed: Jul. 31, 1990

[30] Foreign Application Priority Data

Aug. 3, 1989 [JP] Japan ..... 1-200228

[51] Int. Cl.[5] ..... B22D 11/06; B22D 11/16

[52] U.S. Cl. ..... 164/452; 164/154; 164/428; 164/480

[58] Field of Search ..... 164/428, 480, 154, 413, 164/452, 454

[56] References Cited

U.S. PATENT DOCUMENTS 4,702,300 10/1987 Nakanori et al. ..... 164/428

FOREIGN PATENT DOCUMENTS 59-56950 4/1984 Japan .
60-64754 4/1985 Japan .
60-92051 5/1985 Japan .
61-232044 10/1986 Japan .
61-232045 10/1986 Japan .
61-289950 12/1986 Japan .
62-97749 5/1987 Japan .

*Primary Examiner*—Kuang Y. Lin
*Attorney, Agent, or Firm*—Kenyon & Kenyon

[57] ABSTRACT

A control device for a twin-roll continuous caster, comprising a plurality of maps, each of which teaches a relationship between a thickness of a cast strip and a roll separating force under a fixed casting speed, and teaches stable casting conditions under which bulging and surface cracks do not occur. The device detects a cast thickness and a height of the molten pool and selects an appropriate map from among the plurality of maps, by the detected height, and controls the casting conditions such that a target thickness of the cast strip is obtained under stable casting conditions by using the selected map.

9 Claims, 3 Drawing Sheets

TARGET THICKNESS Ta
I/P
O/P
MPU
RAM·ROM
P
Vc
Vc
Ti
1
2
3
3'
4
4'
5
6
7
8
9
10
10'
11
12
13
14
15
16
17
18
19
20
21
22
23
24
25
26
a
a'

CONTROL DEVICE AND A CONTROL METHOD FOR TWIN-ROLL CONTINUOUS CASTER

BACKGROUND OF THE INVENTION

1. Field of the Invention

The present invention relates to a twin-roll continuous caster by which a cast strip can be directly produced from molten metal. More specifically, it relates to a control device and a control method for the twin-roll continuous caster, which device and method enable the production of a cast strip with high-quality surfaces.

2. Description of the Related Art

In the well-known twin-roll casting process, molten metal is continuously supplied into a molten pool defined between a pair of opposed cooling rolls which rotate in opposite directions, and on each cooling roll a solidified shell is formed by contact between the molten metal and the cooling roll, and thus the solidified shells are bonded at the nearest point of contact of each of the rolls, i.e., a kissing point, to thereby produce a cast strip.

Furthermore, Japanese Unexamined Patent Publication No. 60-64754 discloses a method of eliminating bulging, which occurs during bonding when the roll separating force is low, and to prevent roll slip, which occurs during bonding when the roll separating force is high. Note that bulging results in an unbonded condition of the shell, thereby causing a separation or break out of the cast strip.

In the above method, first a rolling load of the solidified shells, as a force reacting against the roll separating force, is detected, and then a solidification period of the shells between the cooling rolls, which can be representative of either a rotating speed of the cooling rolls or a height of the molten pool, is controlled in such a manner that the rolling load is neither too high nor too low.

Note that, in addition to the above method, Japanese Unexamined Patent Publication Nos. 59-56950, 60-92051, 61-232044, 61-232045, 61-289950, 62-97749 disclose methods or devices for eliminating bulging.

In general, when solidified shells having a given thickness are bonded at the kissing point, the greater the increase of the roll separating force the stronger the binding strength, but when the roll separating force is higher than a predetermined value, many continuous surface cracks extending in the casting direction are produced in the cast strip.

This surface crack phenomenon is due to a local stress concentration generated of the solidified shells when rolling solidified shells having an unequal thickness in the longitudinal direction of the cooling roll. Note, the thicker the target thickness of the cast strip or the higher the roll separating force, the greater the incidence of continuous surface cracks due to larger variations of thickness of the solidified shell. Further, it has been found that surface cracks still occur even when the roll separating force is lower than the roll separating force value at which the afore-mentioned roll slip phenomenon occurs. Therefore, the method of controlling the solidifcation period as disclosed in Japanese Unexamined Patent Publication No. 60-64754, can not prevent the occurence of continuous surface cracks. Further, although the object of Japanese Unexamined Patent Publication No. 62-97749 is to prevent the occurrence of surface cracks by detecting and controlling the roll separating force, it does not consider the influence of the cast thickness upon the occurrence of surface cracks.

SUMMARY OF THE INVENTION

The object of the present invention is to provide a control device and a control method for twin-roll continuous caster, by which bulging is eliminated and the occurrence of continuous surface cracks is prevented, by considering the influence of the cast thickness.

To achieve the object according to the present invention, there is provided a control device for a twin-roll continuous caster including a pair of opposed cooling rolls which rotate in opposite directions, these cooling rolls defining a molten pool therebetween into which molten metal is supplied, and a solidified shell is formed on each cooling roll by a contact between each cooling roll and the molten metal, whereby the solidified shells are bonded at the nearest point of contact of each of the cooling rolls, to thereby continuously produce a cast strip said control device comprising;

a plurality of maps prepared prior to the operation of the twin-roll continuous caster and stored in a memory of the control device, each of the maps corresponding to a height of the molten pool and a casting speed, teaching a relationship between a thickness of the cast strip and a roll separating force under a fixed casting speed and a fixed height of the molten pool, and defining stable casting conditions under which bulging and surface cracks do not occur; these conditions consisting of a combination of a specific range of the thickness of a cast strip and a specific range of the roll separating force; a thickness detecting means for detecting an actual cast thickness of the cast strip being cast; a height detecting means for detecting an actual height of the molten pool; a selecting means for selecting an appropriate map from among the plurality of maps corresponding to the detected actual height of molten pool; and a control means for controlling at least one of the casting speed and the roll separating force in accordance with a difference between the actual cast thickness of the cast strip and an target thickness thereof, in such a manner that the cast strip of the target thickness can be cast under stable casting conditions obtained from the selected appropriate map.

Furthermore, there is provided a control method for a twin-roll continuous caster including a pair of opposed cooling rolls which rotate in opposite directions, said cooling rolls defining a molten pool therebetween into which molten metal is supplied, and a solidified shell is formed on each cooling roll by a contact between each of the cooling rolls with said molten metal, whereby each solidified shell is bonded at the nearest point of contact of each of the cooling rolls, to thereby continuously produce a cast strip, this control method comprising;

preparing a plurality of maps prior to the operation of the twin-roll continuous caster and storing said plurality of maps in a memory of the control device, each of the maps corresponding to a height of the molten pool and a casting speed, teaching a relationship between a thickness of the cast strip and a roll separating force under a fixed casting speed and a fixed height of the molten pool, and defining stable casting conditions under which bulging and surface cracks do not occur, and which consists of a combination of a specific range of the thickness of a cast strip and a specific range of the roll separating force;

detecting an actual cast thickness of the cast strip being cast;

detecting an actual height of the molten pool;

selecting an appropriate map from among plurality of maps corresponding to the detected actual height of molten pool;

controlling at least one of the casting speed and the roll separating force in accordance with a difference between the actual cast thickness of the cast strip and an target thickness thereof; and thereby casting the casting cast strip to the target thickness under the stable casting conditions of the selected appropriate map.

According to the present invention, the plurality of maps are memorized prior to the operation of the twin-roll continuous caster, and during the process of obtaining the actual cast thickness for the target value, the present control device controls the casting conditions, i.e., the casting speed and the roll separating force, in such a manner that the casting operation is executed under specific casting conditions defined by the map as a stable area within which defects such as bulging and surface cracks will not occur.

DESCRIPTION OF THE PREFERRED EMBODIMENT

Figure 3:
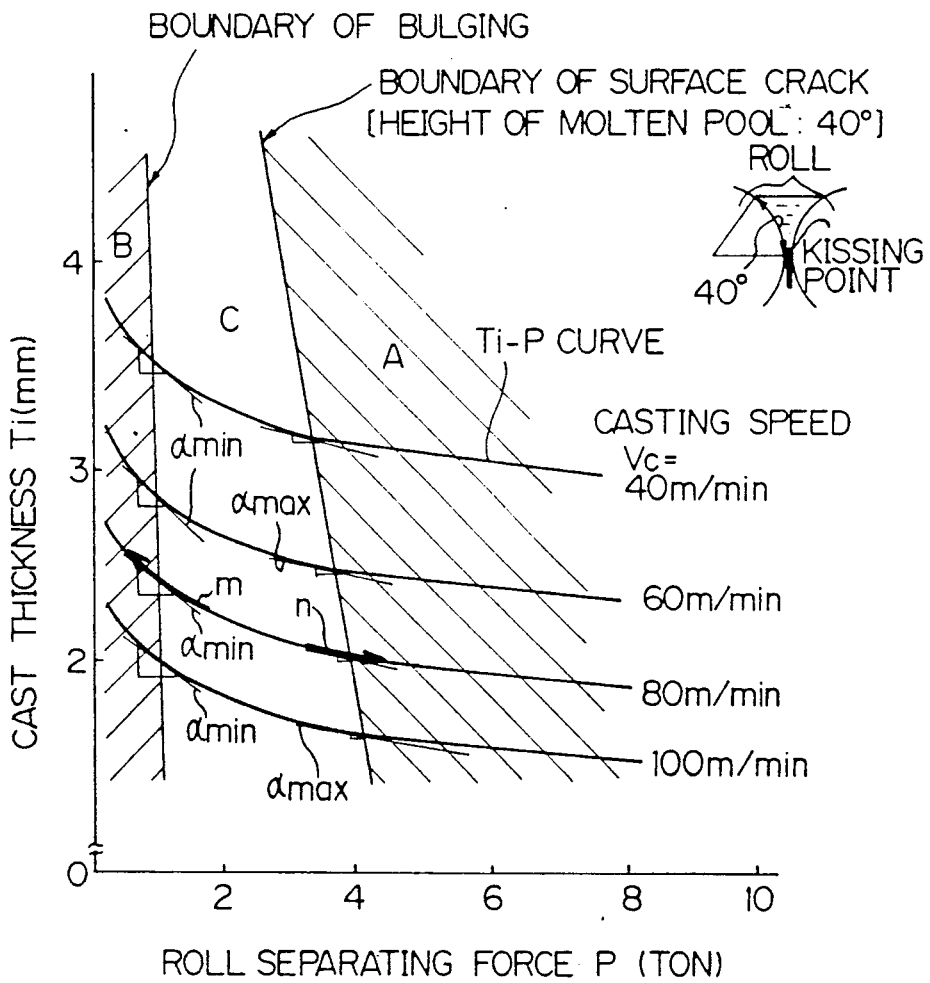
FIG. 3 is a map showing a relationship among the cast thickness, the roll separating force and the quality of the cast strip under various casting speeds and at certain height of the molten pool, which height can be representative of the circumferential angle of 40° from the kissing point.

Prior to a description of the embodiment of the invention, an explanation of a map obtained by experiments by the inventors and utilized by the present control device is given with reference to FIG. 3.

In FIG. 3, the various curves each show a relationship between the cast thickness Ti and the roll separating force P under a fixed casting speed Vc (rotating speeds of cooling roll), at a certain height of the molten pool, which can be expressed as on angle of 40° of the circumference of the cooling roll, assuming that a height at a kissing point thereof corresponds to an angle 0°. Furthermore, FIG. 3 shows three areas of the quality of the cast strip produced under such casting conditions. Namely, according to data obtained by experiments, surface cracks occurred under the casting conditions shown in area A and bulging occurred under the casting conditions shown in area B. Neither surface cracks nor bulging occurred in area C, and thus a cast strip with a stable quality was obtained in this area.

A control device in accordance with the invention stores a map corresponding to each height of the molten pool as represented in the above-mentioned figure, and during the control of the thickness of the cast strip to a target value, the device controls the casting conditions so that they are within the area C, as shown in FIG. 3, and thus it is possible to cast a cast strip having the target thickness without the occurrence of bulging or surface cracks.

Figure 1:
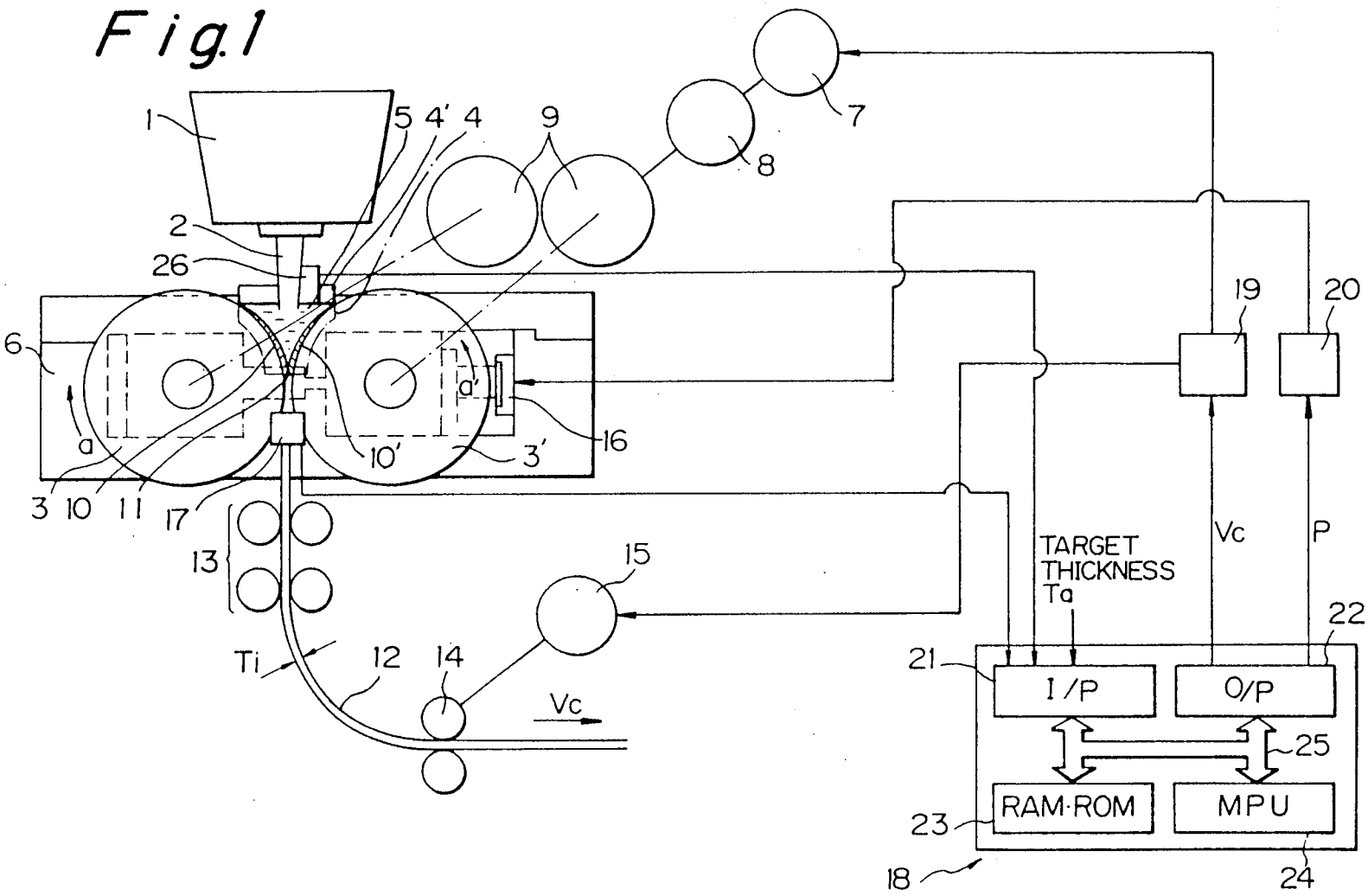
FIG. 1 shows a general construction of a twin-roll continuous caster equipped with a control device according to the present invention.

Referring to FIG. 1, a molten metal is supplied from a ladle (not shown) into a tundish 1, and then is poured through a nozzle 2 extending downward from the tundish 1 into a molten pool 5 defined by a pair of cooling rolls 3 and 3' and a pair of side dams 4 and 4' pressed against both end surfaces of the cooling rolls 3 and 3'.

When casting, a refrigerant such as cooling water is charged into the cooling rolls 3 and 3', to thereby forcibly cool same to control the temperature at the outer surfaces thereof. The cooling rolls 3 and 3' are rotatably supported by a housing 6 and are respectively rotated by a drive motor 7 through the intermediary of a reduction gear device 8 and synchromesh gears 9 and 9', which cooperate with the cooling rolls 3 and 3', respectively. Therefore, during casting, each roll 3 or 3' rotates in a direction opposite to the other, as shown by arrows "a" and "a'".

Then, due to the cooling of the rolls 3 and 3', solidified shells 10 and 10 are produced on each surface of the rolls 3 and 3' in contact with the molten pool 5, and the shells 10 and 10' are bonded to each other at a gap 11 (herein called the kissing point) at which a distance between the rolls 3 and 3' is at a minimum, to thereby produce a cast strip 12. Subsequently, the cast strip 12 is drawn downward by pinch rolls 13 and 14 arranged downstream in the casting direction and is transferred to a following process (not shown). Note, the pinch rolls 14 are rotated by a drive motor 15 in synchronization with the rotating speed of the cooling rolls 3 and 3'.

The cooling roll 3' is supported by the housing 6 in such a manner that the roll 3' can be moved toward and away from the cooling roll 3. For this purpose, the roll 3' is provided with an actuator 16 such as a hydraulic cylinder by which the roll separating force for the solidified shells 10 and 10' can be varied.

The housing 6 is provided with a sensor 17 for detecting the width of the gap 11, i.e., the cast thickness Ti of the cast strip 12. Note that the cast thickness Ti may be calculated by detecting the position of the cooling roll 3' in the housing 6.

The drive motors 7 and 15 are electrically connected to a control circuit 18 through the intermediary of a drive circuits 19, and the actuator 16 is electrically connected to the circuit 18 through a drive circuit 20.

The control circuit 18, which may be constructed by, for example, a microcomputer, comprises an inputport (I/P) 21, an outputport (O/P) 22, a memory 23 having a Random Access Memory (RAM) and a Read Only Memory (ROM), a Microprocessing Unit (MPU) 24, and a bus 25 interconnecting these units. The inputport 21 is constituted by an analog input circuit receiving a signal generated from the cast thickness detecting sensor 17, an interface, and an analog/digital converter. The outputport 22 generates a variable drive output signal Vc and outputs same to the drive circuit 19, and generates another variable drive output signal P and outputs same to the drive circuit 20.

The signal from the cast thickness detecting sensor 17 and a signal from a level sensor 26 for detecting the height of the molten pool 5 are input to the inputport 21. Furthermore, a target thickness Ta, which is determined by a specification of the cast strip to be produced, is input to the inputport 21 by an operator.

In the operation, based on the input target thickness Ta and the detected height of the molten pool 5, the control circuit 18 (in particular, the MPU 24) selects an appropriate map (for example, FIG. 3) from among a plurality of maps prestored in the ROM and corresponding to different heights of the molten pool 5, determines an appropriate roll separating force P and an appropriate casting speed Vc within an area C at which surface cracks and bulging do not occur, generates output signals corresponding to the roll separating force and the casting speed, and outputs same to the drive circuits 19 and 20, respectively.

Figure 2:
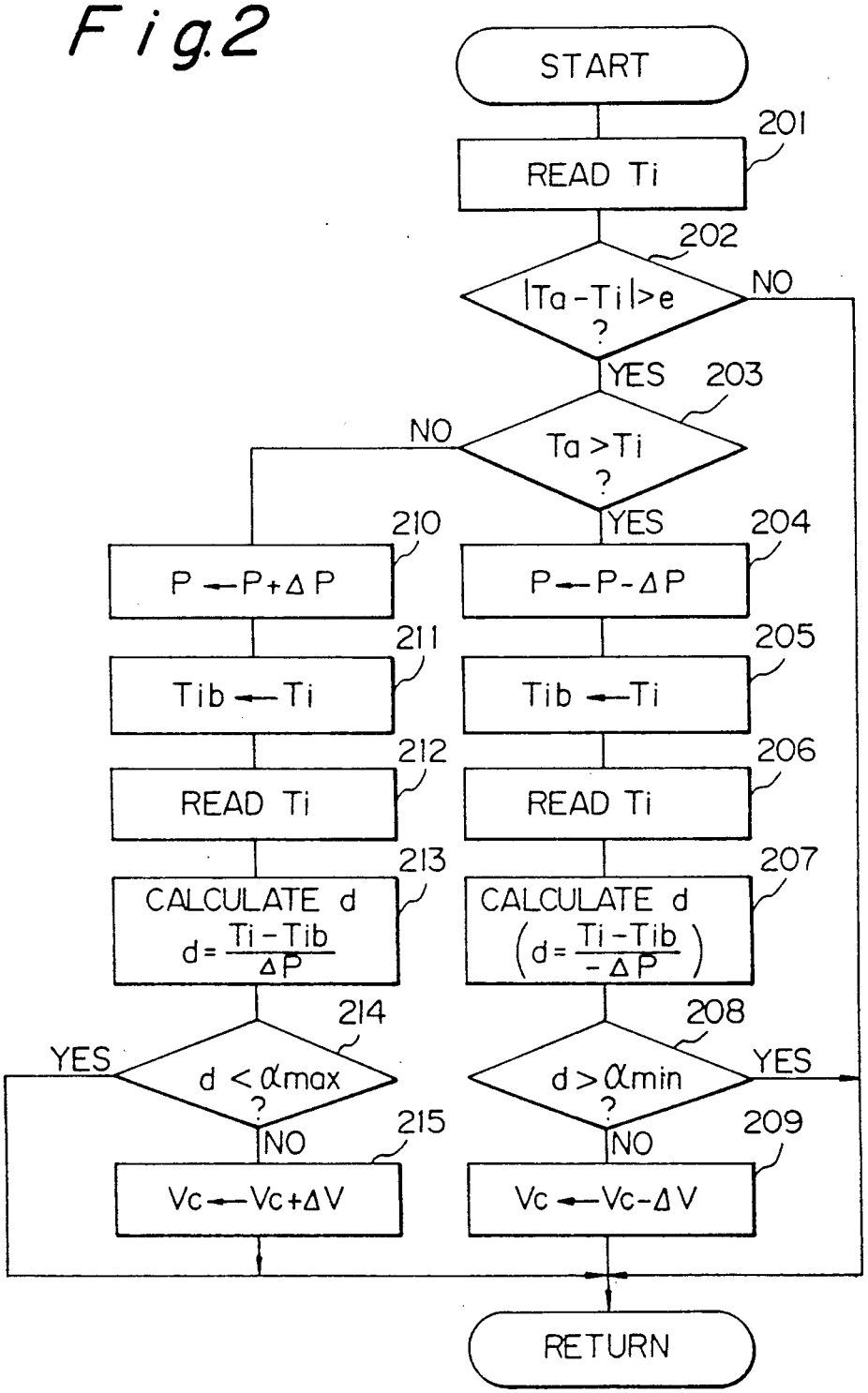
FIG. 2 is a flow chart executed by the control device to control the casting conditions, according to the present invention.

Note, although the casting operation is started under the casting conditions determined as described above, sometimes an actual cast thickness Ti of the cast strip 12 is deviated from the target thickness Ta due to a disturbance or variation of the casting conditions per se. FIG. 2 shows a flow-chart of the operation of the control circuit 18 whereby, by changing the roll separating force P and/or the casting speed Vc, the cast thickness Ti is brought to the target thickness Ta without the occurrence of bulging or surface cracks even if the actual thickness Ti is different from the target thickness Ta. The program for executing the above operation is stored in a predetermined area of the ROM of the control circuit 18 and is executed at predetermined intervals during the casting. Note that, according to this embodiment, an appropriate map having predetermined values such as $\alpha$-max and $\alpha$min shown in FIG. 3 is selected by the control circuit 18 in accordance with a height of the molten pool 5 detected by the level sensor 26, and the target thickness Ta is stored in the memory 23 prior to the following operation.

Referring to FIG. 2, at step 201, an actual cast thickness Ti of the cast strip 12 is detected by the cast thickness detecting sensor 17, and at step 202, it is determined whether or not the detected thickness Ti is different from the prestored target thickness Ta, i.e., in detail, whether or not the absolute difference between Ti and Ta is greater than the allowable error "e".

Assuming that the casting conditions are such that the target thickness Ta is 2.2 mm, the speed Vi is 80 m/min. and the roll separating force Pi is 3 ton, if the detected actual thickness Ti is 2.1 mm when the allowable error "e" is 0.05 mm, the result at step 202 will be "Yes", and thus the routine goes to step 203.

On the other hand, if it is determined the actual thickness Ti is substantially the same as the target thickness Ta, i.e., if the difference between Ti and Ta is within the allowable error "e", the routine is ended and the following steps are omitted.

At step 203, it is determined whether or not the target thickness Ta is greater than the actual thickness Ti. If the result at step 203 is "Yes", i.e., when the actual thickness Ti is less than the target thickness Ta, as mentioned in the above numerical example, the routine goes to step 204 and the actual roll separating force P is reduced by a predetermined value $\Delta P$ (e.g., 0.1 ton ) to enable an increase of the actual thickness Ti.

Then, at step 205, the actual thickness as the previous Ti read at step 201 is stored in the memory 23 as the thickness value (before changing the roll separating force), and thereafter, at step 206, the present cast thickness Ti (after the change of the roll separating force) is newly detected by the cast thickness detecting sensor 17.

Next, at step 207, a ratio "d" of the variation of the cast thickness relative to a variation of the roll separating force at step 204 is calculated as follows:

$$d=(Ti-Tib)/-\Delta P$$

, where $Ti>Tib$, $\Delta P>0$, and therefore, $d<O$

On the other hand, when the result at step 203 is NO, i.e., when the detected actual cast thickness Ti is greater than the target thickness Ta, processes similar to the above-mentioned processes from step 204 to step 207 are executed. Namely, at step 210, the actual roll separating force P is increased by a predetermined value $\Delta P$ (ex. 0.1 ton), to thereby reduce the actual thickness Ti.

Then, at step 211, the actual thickness Ti read at step 201 converted to a value Tib before the change of the roll separating force, and the value Tib is stored in the memory 23 of the control circuit 18. Thereafter, at step 212, the present cast thickness Ti after the change of the roll separating force is newly detected by the cast thickness detecting sensor 17.

Next, at step 213, a ratio "d" of the variation of the cast thickness relative to a variation of the roll separating force found at step 210 is calculated as follows:

$$d=(Ti-Tib)/\Delta P$$

, where $Ti<Tib$, $\Delta P>0$, and therefore, $d<O$.

Generally speaking, when the roll separating force P is lowered to increase the cast thickness, as shown by an arrow "m" in FIG. 3, a serious problem arises in that the new casting condition may be included in the bulging area B of FIG. 3, due to the change of the casting condition. Therefore, at step 208, it is determined whether the calculated "d" at step 207 is more than the minimum value $\alpha$min ($\alpha$min$<0$) of the ratio "d", which is substantially a constant value, independent of the casting speed Vc, obtained by experiments by the inventors, and which is a slope of the tangent to the cast thickness-roll separating force (Ti-P) curves at crossing points with a boundary line between the area B and the area C in FIG. 3. Namely, at step 208, it is determined whether or not two sheets of solidified shells can be bonded without producing a bulge.

If the result at step 208 is "No", since the calculated ratio "d" is less than the minimum value $\alpha$min, i.e., if it is determined that the present casting condition is in the area B, then the routine goes to step 209 and the control circuit 18 outputs a signal to the drive circuit 19 so that the casting will be held at a new casting speed ($Vc-\Delta V$) which is lower than the present casting speed Vc by a predetermined value $\Delta V$ (e.g., 5 m/min.).

Consequently, the thickness Ti of the cast strip 12 can be increased while maintaining the same roll separating force P, since the corresponding curve of the cast thickness-roll separating force is shifted upward due to the reduction of the casting speed. Also, corresponding to this shift, the operation point is moved out of the bulge area B, since the smaller the casting speed the narrower becomes the range at which bulging will occur, as shown in FIG. 3, and this routine is then ended. Note, when the result at step 208 is "Yes", i.e., when a new casting condition established at this time is in the area C of FIG. 3, the routine is ended by skipping step 209, and thus at step 202 in the next routine, it will be determined whether or not the obtained cast thickness Ti is different from the target thickness Ta.

Conversely, when the actual cast thickness Ti is larger than the target thickness Ta, the process for reducing the cast thickness is executed at step 210. Here, however, a new problem may arise in that the new casting condition may be in the area A at which surface cracks occur, due to the change of the casting condition, as shown by an arrow "n" in FIG. 3.

Therefore, at step 214, it is determined whether the calculated "d" at step 213 is less than the maximum value $\alpha max$ ($\alpha max<0$) of the ratio "d", which is also substantially a constant value independent of the casting speed Vc obtained from experiments by the inventors, and which is a slope of the tangent to Ti−P curves at crossing points with a boundary line between the area A and the area B in FIG. 3, similar to the afore-mentioned minimum value $\alpha min$. Nomely, at step 214, it is determined whether the present casting condition (the casting speed Vc and the roll separating force P) is in the area C at which surface cracks do not occur.

If the result at step 214 in "No", i.e., if it is determined that present casting condition is in the area A, then the routine goes to step 215 and the control circuit 18 outputs a signal to the drive circuit 19 to cause the casting to be held at a new casting speed ($Vc+\Delta V$), which is higher than the present casting speed Vc by a predetermined value $\Delta V$ (e.g. 5 m/min.).

Consequently, the rotating speeds of the cooling rolls 3 and 3' and the pinch roll 14 are increased at the same time, and thus the period of solidification of the shells 10 and 10' is reduced. Due to this reduction of the solidification period, the thickness Ti of the cast strip 12 can be reduced while using the same roll separating force P, since the corresponding curve of the cast thickness-roll separating force is shifted downward in FIG. 3. Further, corresponding to this shift, the operation point is moved out of the bulge area A, since the higher the casting speed Vc the narrower becomes the range in which surface cracks occur, as shown in FIG. 3, and finally, the operation point will be contained in the area C by one or more executions of this routine thereafter.

Note, when the result at step 214 is "Yes", i.e., when a new casting condition established at this time is in the area C of FIG. 3, the routine is ended by skipping step 215, and thus at step 202 in the next routine it will be determined whether or not the obtained cast thickness Ti is different from the target thickness Ta. If the target thickness Ta can not be realized, the processes after step 210 are repeatedly executed until the target thickness Ta is finally obtained. Note, as shown in FIG. 3, the maximum value $\alpha max$ employed at step 214 is also a constant value independent of the casting speed Vc, obtained from experiments by the inventors, and each maximum value $\alpha max$ is prestored in the memory 23 for each height of the molten pool 5, as well as the aforementioned minimum values $\alpha min$.

As is obvious from description of the above embodiment, the control circuit 18 controls the casting conditions, such as the roll separating force and the casting speed, in such a manner that the ratio "d", which can be calculated when controlling the cast thickness, is between the minimum ratio $\alpha min$ corresponding to a boundary at which bulging occurs and the maximum ratio $\alpha max$ corresponding to boundary at which surface cracks occur.

Although the above embodiment describes these values $\alpha min$ and $\alpha max$ as constant values independent of the casting speeds, it will be understood that, if desired, the values $\alpha min$ and $\alpha max$ can be precisely obtained in accordance with each casting speed, by casting experiments, and can then be memorized in the memory, and during the operation, an appropriate value can be selected in accordance with the detected height of the molten pool and the casting speed.

As described above, according to the present invention, a cast strip with an improved surface quality can be provided since, in the control of thickness of the cast strip to be cast by the twin-roll continuous caster, the target thickness of the cast strip can be obtained, and the roll separating force and the casting speed controlled to ensure that neither bulging nor surface cracks occur.

We claim:

1. A control device for a twin-roll continuous caster including a pair of opposed cooling rolls which rotate in opposite directions, said cooling rolls defining a molten pool therebetween into which molten metal is supplied, and a solidified shell is formed on each cooling roll by a contact between each of said cooling rolls with said molten metal, whereby each solidified shell is bonded at the nearest point of contact of each of said cooling rolls, to thereby continuously produce a cast strip, said control device comprising;

a plurality of maps prepared prior to the operation of said twin-roll continuous caster and stored in a memory of said control device, each of said maps corresponding to a height of said molten pool and a casting speed, teaching a relationship between a thickness of said cast strip and a roll separating force under a fixed casting speed and a fixed height of said molten pool, and defining stable casting conditions under which bulging and surface cracks do not occur, and which consists of a combination of a specific range of said thickness of cast strip and a specific range of said roll separating force;

thickness detecting means for detecting an actual cast thickness of said cast strip being cast;

height detecting means for detecting an actual height of said molten pool;

selecting means for selecting an appropriate map from among said plurality of maps corresponding to the detected actual height of molten pool; and control means for controlling at least one of said casting speed and said roll separating force in accordance with a difference between said actual cast thickness of said cast strip and an target thickness thereof, in such a manner that said cast strip of said target thickness can be cast under said stable casting conditions of said selected appropriate map.

2. A control device according to claim 1, wherein said thickness detecting means comprise a cast thickness sensor for detecting a distance between said cooling rolls at a nearest point of contact therebetween.

3. A control device according to claim 2, wherein said height detecting means comprise a level sensor for detecting a height of said molten pool.

4. A control device according to claim 3, wherein said control means comprise an actuator by which said roll separating force can be varied, a drive circuit for activating said actuator, a drive motor for rotating said cooling rolls, and a drive circuit for driving said motor.

5. A control device according to claim 4, wherein said actuator is a hydraulic cylinder.

6. A control device according to claim 5, wherein when a difference between said target thickness and said actual thickness of said cast strip being cast is detected, said control means operate said drive circuit to thereby drive said actuator and thereby vary said roll separating force.

7. A control device according to claim 6, wherein said control means calculate a ratio of a variation of said cast thickness relative to a variation of said roll separating force, to determine whether the casting operation is being carried out under said stable casting conditions of said selected appropriate map.

8. A control device according to claim 7, wherein when it is determined that said casting operation is not being carried out under said stable casting conditions, said control means operates said drive circuit to drive said drive moter, to thereby vary said casting speed.

9. A control method for a twin-roll continuous caster including a pair of opposed cooling rolls which rotate in opposite directions, said cooling rolls defining a molten pool therebetween into which molten metal is supplied, and a solidified shell is formed on each cooling roll by a contact between each of the cooling rolls with said molten metal, whereby each solidified shell is bonded at the nearest point of contact of each of the cooling rolls, to thereby continuously produce a cast strip, this control method comprising;

preparing a plurality of maps prior to the operation of the twin-roll continuous caster and storing said plurality of maps in a memory of the control device, each of the maps corresponding to a height of the molten pool and a casting speed, teaching a relationship between a thickness of the cast strip and a roll separating force under a fixed casting speed and a fixed height of the molten pool, and defining stable casting conditions under which bulging and surface cracks do not occur, and which consists of a combination of a specific range of the thickness of a cast strip and a specific range of the roll separating force;

detecting an actual cast thickness of the cast strip being cast;

detecting an actual height of the molten pool;

selecting an appropriate map from among plurality of maps corresponding to the detected actual height of molten pool;

controlling at least one of the casting speed and the roll separating force in accordance with a difference between the actual cast thickness of the cast strip and an target thickness thereof; and thereby casting said cast strip to the target thickness under the stable casting conditions of the selected appropriate map.

* * * * *

UNITED STATES PATENT AND TRADEMARK OFFICE

CERTIFICATE OF CORRECTION

PATENT NO. : 5,052,467

DATED : October 1, 1991

INVENTOR(S) : Shigenori TANAKA, et al.

It is certified that error appears in the above-identified patent and that said Letters Patent is hereby corrected as shown below:

Column 1, line 50, change "of" to --by--.

Column 2, line 20, after "strip" insert a comma--.

Column 2, line 42, change "an" to --a--.

Column 3, line 9, change "an" to --a--.

Column 3, line 49, change "on" to --an--.

Column 4, line 43, change "circuits" to --circuit--.

Column 5, line 37, between "the" and Speed" insert --casting--.

Column 7, line 18, change "Nomely," to --Namely,--.

Column 8, line 48, change "an" to --a--.

Column 9, line 14, change "moter" to --motor--.

UNITED STATES PATENT AND TRADEMARK OFFICE

CERTIFICATE OF CORRECTION

PATENT NO. : 5,052,467

DATED : October 1, 1991

INVENTOR(S) : Shigenori TANAKA, et al.

It is certified that error appears in the above-identified patent and that said Letters Patent is hereby corrected as shown below:

Column 10, line 22, change "an" to --a--.

Signed and Sealed this

Thirtieth Day of November, 1993

Bruce Lehman

BRUCE LEHMAN

*Commissioner of Patents and Trademarks*

*Attest:*

*Attesting Officer*